US009570853B1

(12) United States Patent
Yu

(10) Patent No.: US 9,570,853 B1
(45) Date of Patent: Feb. 14, 2017

(54) CIRCULAR RAPID-JOINT CONNECTOR

(71) Applicant: T-CONN PRECISION CORPORATION, New Taipei (TW)

(72) Inventor: Chien-Yi Yu, New Taipei (TW)

(73) Assignee: T-CONN PRECISION CORPORATION, New Taipei (TW)

( * ) Notice: Subject to any disclaimer, the term of this patent is extended or adjusted under 35 U.S.C. 154(b) by 0 days.

(21) Appl. No.: 14/944,279

(22) Filed: Nov. 18, 2015

(30) Foreign Application Priority Data

Oct. 16, 2015 (TW) ..... 104216558 A

(51) Int. Cl.
*H01R 13/639* (2006.01)

(52) U.S. Cl.
CPC ..... *H01R 13/639* (2013.01)

(58) Field of Classification Search
USPC ..... 439/352, 348, 141, 152, 349
See application file for complete search history.

(56) References Cited

U.S. PATENT DOCUMENTS 4,017,139 A * 4/1977 Nelson ..... H01R 13/639 285/316
4,545,633 A * 10/1985 McGeary ..... H01R 13/6277 439/141
4,548,455 A * 10/1985 Ezure ..... H01R 13/627 439/152
5,147,221 A * 9/1992 Cull ..... H01R 24/40 439/585
5,176,533 A * 1/1993 Sakurai ..... H01R 13/6277 439/350
5,746,619 A * 5/1998 Harting ..... H01R 24/40 439/352
5,807,129 A * 9/1998 Konda ..... H01R 13/6271 439/348
6,093,043 A * 7/2000 Gray ..... H01R 13/622 439/352
6,179,641 B1 * 1/2001 Kaneko ..... H01R 13/6277 439/349
6,517,373 B2 * 2/2003 Finke ..... H01R 13/635 439/352
6,715,801 B2 * 4/2004 Zhadanov ..... F16L 37/62 285/316

(Continued)

*Primary Examiner* — Alexander Gilman
(74) *Attorney, Agent, or Firm* — Bacon & Thomas, PLLC

(57) ABSTRACT

The invention is a circular rapid-joint connector comprising a sliding bush; an elastic element provided on the inner edge of the sliding bush; a holding unit joined with the sliding bush movably; and a connector plug penetrating into the sliding bush and joined with the holding unit. Thereby, in assembling, direct docking with a connection socket by the connector plug is available for the connection socket to push away the sliding bush. After the connection socket and the connector plug are snap-fitting, the sliding bush is pushed back by the elastic element automatically, such that the sliding bush is locked to the outer edge of the connection socket to complete the operation of assemblage. In disassembling, the sliding bush is pulled backwards such that the sliding bush is not limited to the outer edge of the connection socket any more. After that, a force may be applied to remove the connector plug from the connection socket directly, so that the effects of rapid assembling, solid joining, rapid disassembling, simple structure and facile of use are accomplished.

4 Claims, 11 Drawing Sheets

(56) References Cited

U.S. PATENT DOCUMENTS

| | | | | |
|---|---|---|---|---|
| 6,824,415 | B2 * | 11/2004 | Wlos | H01R 13/6276 439/348 |
| 6,942,516 | B2 * | 9/2005 | Shimoyama | H01R 13/6272 439/352 |
| 7,201,608 | B2 * | 4/2007 | Rosenberger | H01R 13/6277 439/352 |
| 7,322,846 | B2 * | 1/2008 | Camelio | H01R 13/6277 439/352 |
| D587,202 | S * | 2/2009 | Dobler | D13/133 |
| 7,892,004 | B2 * | 2/2011 | Hertzler | H01R 13/5219 439/312 |

* cited by examiner

CIRCULAR RAPID-JOINT CONNECTOR

BACKGROUND OF THE INVENTION

Field of the Invention

The invention is a circular rapid-joint connector, particularly relating to one which may be in direct docking with a connection socket by a connector plug when using, such that effects of rapid joint, solid joining, rapid disassembling, simple structure and facile of use are accomplished.

Descriptions of the Related Art

Conventionally, the "Circular Connector", U.S. Pat. No. 6,517,373 B2, includes a first connector element and a second connector element each of which has a first contact inset or a respective second contact inset in which, around the first contact inset of the first connector element, a sleeve-shaped latch segment is arranged from which, running along the longitudinal direction of the connector, one or more resilient latch flanges with latch tabs are formed that are appropriate for locking onto a ring-shaped groove formed on the inner side of the second connector element (locking position) and in which the first connector element includes an outer directly manually operated sleeve-shaped actuation slide, which can be slid back against a spring force along the longitudinal direction of the connector (unlocking position) and is adapted to actuate one or more sliding supports as locking elements, which can be slid along the longitudinal direction of the connector under a section of the latch flanges and are appropriate for supporting the latch flanges (locking position), characterized in that the latch flanges formed from the latch segment are integrally fixed to an end thereof in a manner ending rearwardly toward the actuation slide, that the sliding supports are formed from an end of the actuation slide and are directed directly toward the free ends of the latch segments, wherein the sliding supports extend from outside of the latch flanges essentially beneath their free ends only, when the actuation slide is pushed forward under the force of the spring.

From the cited patent described above, after the plug and the socket are docked, the actuation slide has to be pushed further in order for inserting the sliding supports beneath the latch flanges, such that the latch tabs are pushed and fastened into the ring-shaped groove, so that the operation of insertion and latching may be accomplished. As a result, cumbersome insertion procedure and complex structure will inhibit rapid connection in use of the conventional connector.

In view of this, the inventor has researched and developed a circular rapid-joint connector in order to improve the above conventional connector with respect to various shortages thereof.

SUMMARY OF THE INVENTION

For a major objective of the invention, in assembling, direct docking with the corresponding connection socket by the connector plug is available for the connection socket to push away the sliding bush. After the connection socket and the connector plug are snap-fitting, the sliding bush is pushed back by the elastic element automatically, such that the sliding bush is locked to the outer edge of the connection socket to complete action of assemblage. In disassembling, the sliding bush is pulled backwards such that the sliding bush is not limited to the outer edge of the connection socket any more. After that, a force may be applied to remove the connector plug from the connection socket directly, so that the effects of rapid assembling, solid joining, rapid disassembling, simple structure and facile of use are accomplished.

In order to achieve the objective described above, the invention is a circular rapid-joint connector including: a sliding bush; an elastic element provided on the inner edge of the sliding bush; a holding unit joined with the sliding bush movably; and a connector plug penetrating into the sliding bush and joined with the holding unit.

In the embodiment described above, a containing area capable of accommodating the elastic element is provided on the inner edge of the sliding bush, an end of the sliding bush has multiple buckle holes engaged with the holding unit, and the inner edge of another end of the sliding bush has a stop portion abutting against the connector plug.

In the embodiment described above, the holding unit comprises a sleeve, a collar provided in the sleeve, and a locking bush joined with the sleeve.

In the embodiment described above, the outer edge of the sleeve has multiple buckles docking with the buckle holes respectively, and an end of the sleeve has multiple adjacent elastic pieces, the inner surface of each of the elastic pieces being provided with a respective sticking point, while the periphery of the collar is provided with a slot docking with each of the sticking points, and the inner edge of the sleeve is provided with a first internal thread portion joined with the connector plug, moreover, a first external thread portion is provided on the outer edge of the sleeve where each of the elastic pieces is adjacent thereto, while the inner edge of the locking bush is provided with a second internal thread portion joined with the first external thread portion.

In the embodiment described above, an end of the connector body has a top portion, another end has a second external thread portion joined with the first internal thread portion, and the connector plug is provided with multiple insertion terminals therein, while one side of the top portion is provided with an annular plate abutting against the stop portion, and the top portion is provided with a ditch thereon annularly.

In the embodiment described above, the top portion is provided with a marking portion thereon, and the connector plug is provided with a guiding portion therein.

BRIEF DESCRIPTION OF THE DRAWINGS

FIGS. 11-1 to 11-4 are schematic diagrams showing actions of assemblage and disassemblage of the invention.

DETAILED DESCRIPTION OF THE PREFERRED EMBODIMENT

For thorough understanding of objectives, features and effects of the invention, the invention is described in detail as following in conjunction with attached drawings by means of embodiments.

Figure 1:
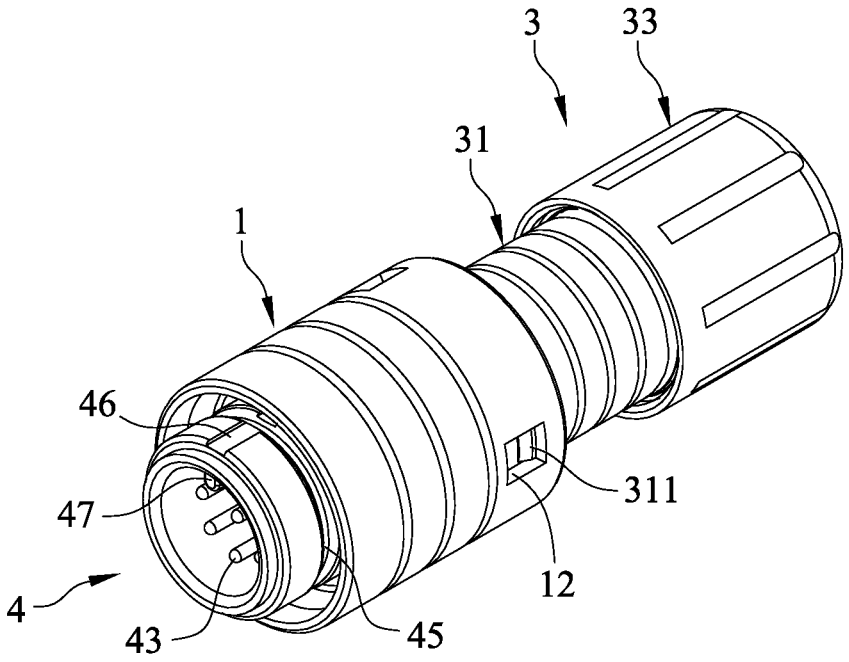
FIG. 1 is a schematic diagram showing the appearance of the invention.
Figure 2:
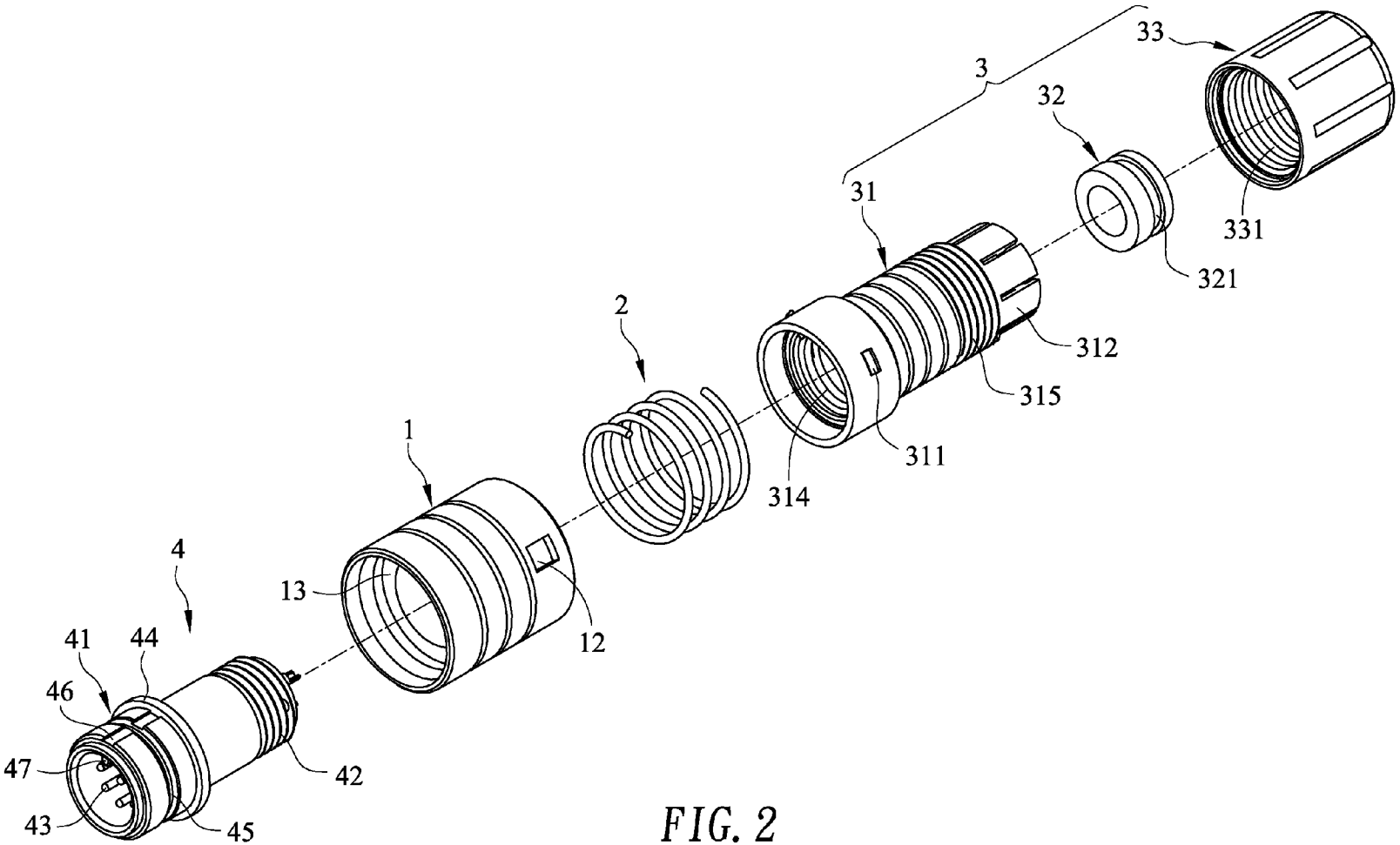
FIG. 2 is an exploded schematic diagram showing elements of the invention.
Figure 3:
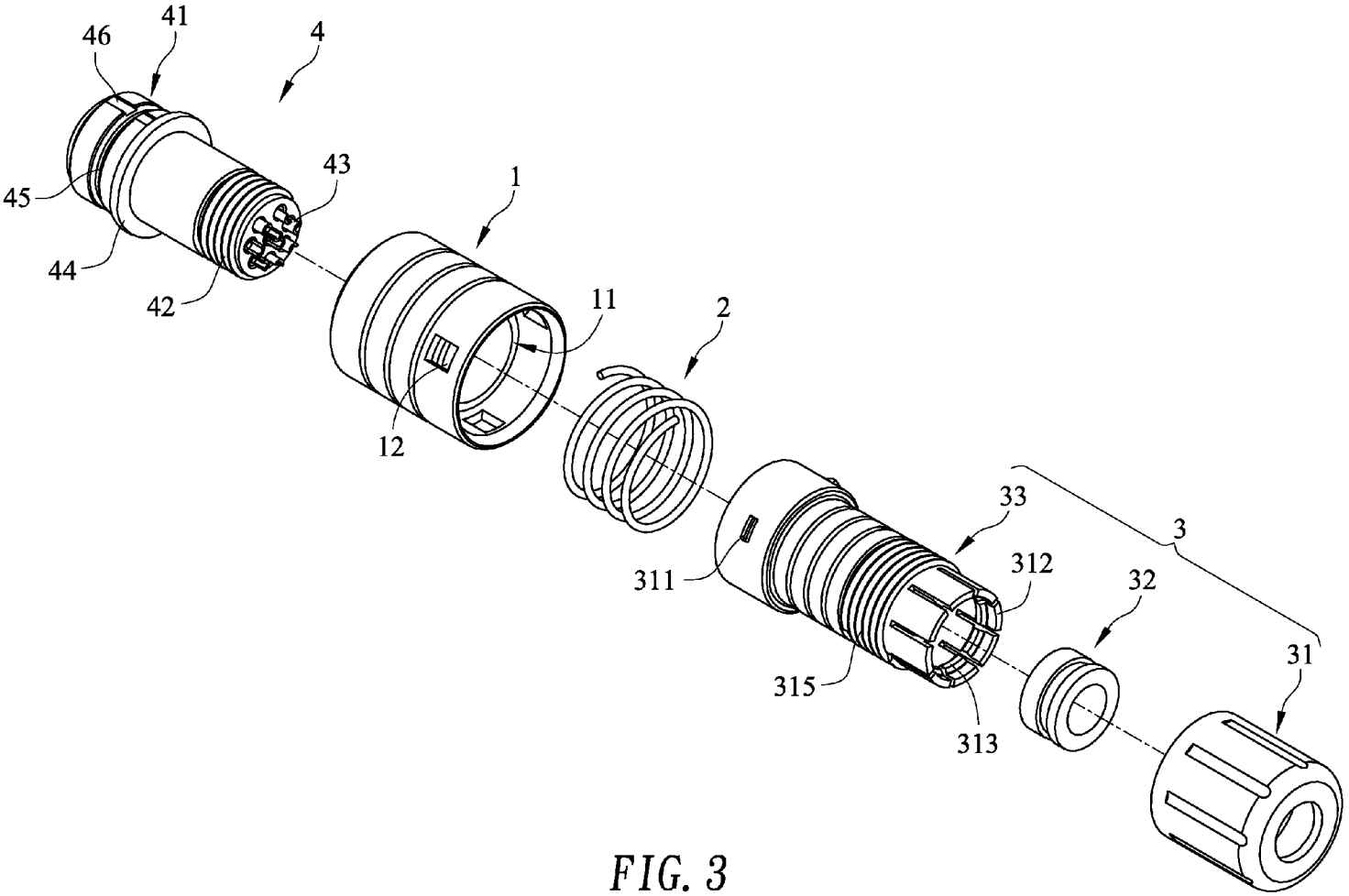
FIG. 3 is another exploded schematic diagram showing elements of the invention.
Figure 4:
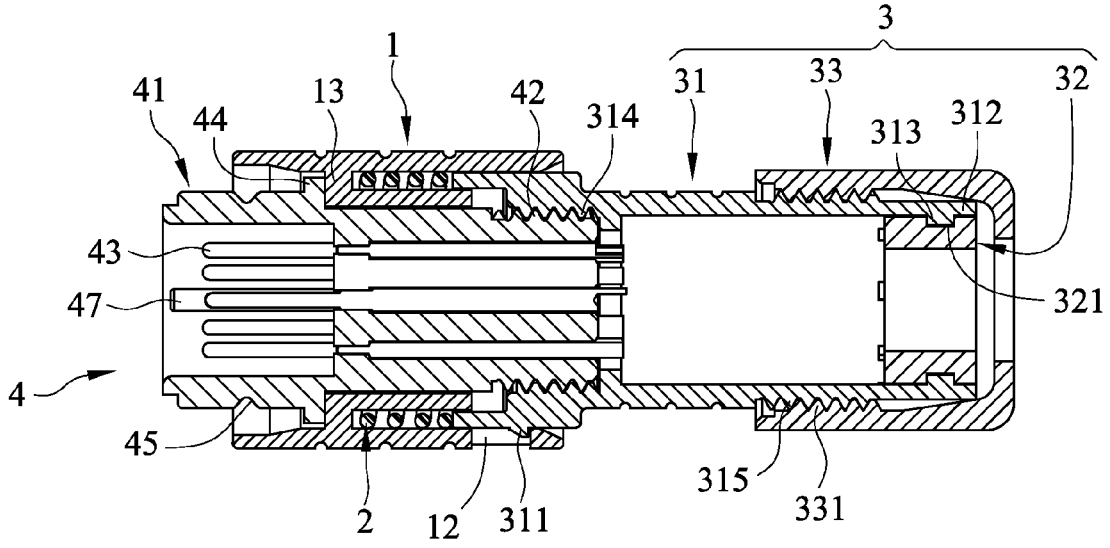
FIG. 4 is a schematic diagram showing a cross section of the invention.

Refer to FIGS. 1, 2, 3 and 4, which are a schematic diagram showing appearance of the invention, an exploded schematic diagram showing elements of the invention, another exploded schematic diagram showing elements of the invention, and a schematic diagram showing a cross section of the invention, respectively. As shown in the figures, the invention is a circular rapid-joint connector comprised at least of a sliding bush 1, an elastic element 2, a holding unit 3 and a connector plug 4.

The inner edge of the sliding bush 1 is provided with a containing area 11, and an end of the sliding bush 1 has multiple buckle holes 12 while the inner edge of another end of the sliding bush 1 has a stop portion 13.

The elastic element 2 is disposed in the containing area 11 of the inner edge of the sliding bush 1.

The holding unit 3 is joined with the sliding bush 1 movably. Moreover, the holding unit 3 comprises a sleeve 31, a collar 32 provided in the sleeve 31, and a locking bush 33 joined with the sleeve 31, wherein the outer edge of the sleeve 31 has buckles 311 docked with respective buckle holes 12. Furthermore, the buckle holes 12 of the sliding bush 1 are larger than the buckles 311 of the sleeve 31, and an end of the sleeve 31 has multiple adjacent elastic pieces 312, the inner surface of each of the elastic pieces 312 is provided with a respective sticking point 313, while the periphery of the collar 32 is provided with a slot 321 docked with each sticking point 314, and the inner edge of the sleeve 31 is provided with a first internal thread portion 314. In addition, a first external thread portion 315 is provided on the outer edge of the sleeve 31 where each of the elastic pieces 312 is adjacent thereto, while the inner edge of the locking bush 33 is provided with a second internal thread portion 331 joined with the first external thread portion 315.

The connector plug 4 is penetrated into the sliding bush 1 and joined with the holding unit 3, while an end of the connector plug 4 has a top portion 41, another end has a second external thread portion 42 joined with the first internal thread portion 314, and the connector plug 4 is provided with multiple insertion terminals 43 therein. Moreover, one side of the top portion 41 is provided with an annular plate 44 abutting against the stop portion 13, and the top portion 41 is provided with a ditch 45 thereon. In addition, the top portion 41 is provided with a marking portion 46 thereon, and the connector plug 4 is provided with a guiding portion 47 therein.

Figure 5:
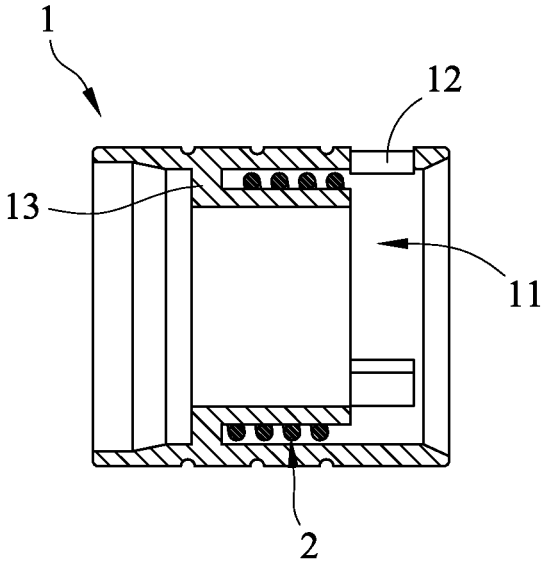
FIGS. 5 to 9 are schematic diagrams showing assemblage of the invention.
Figure 6:
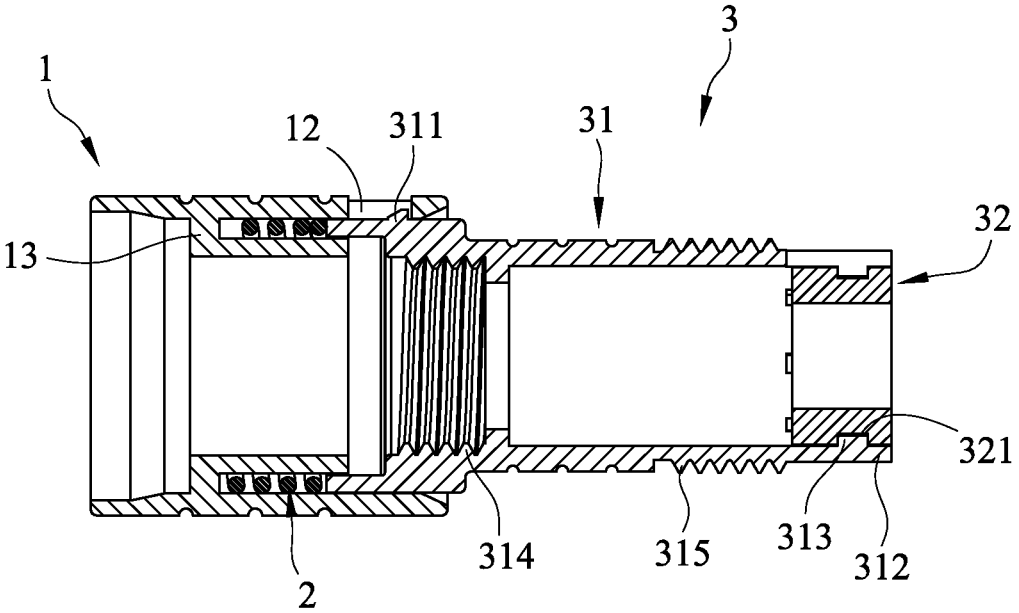
Figure 7:
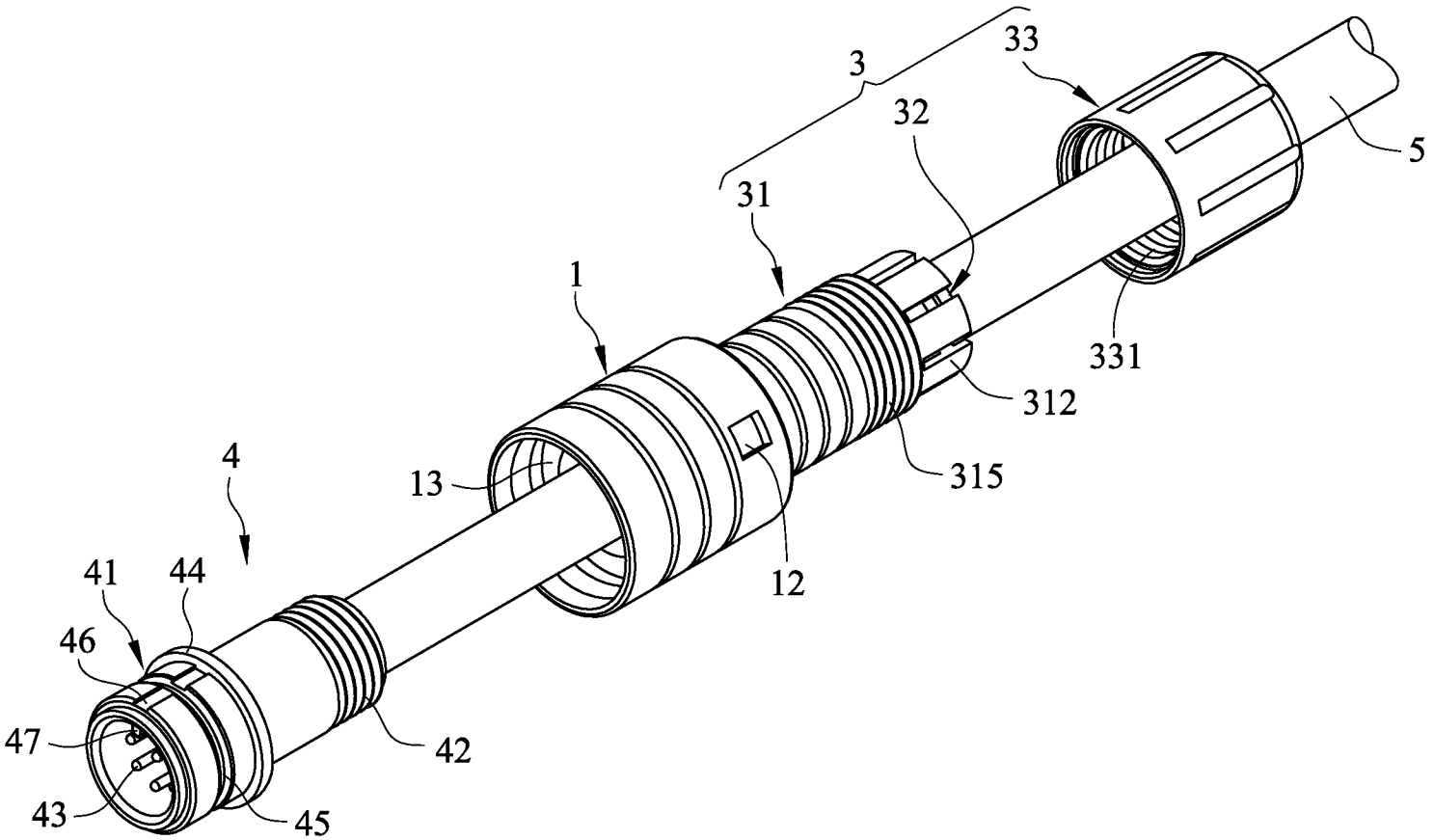
Figure 8:
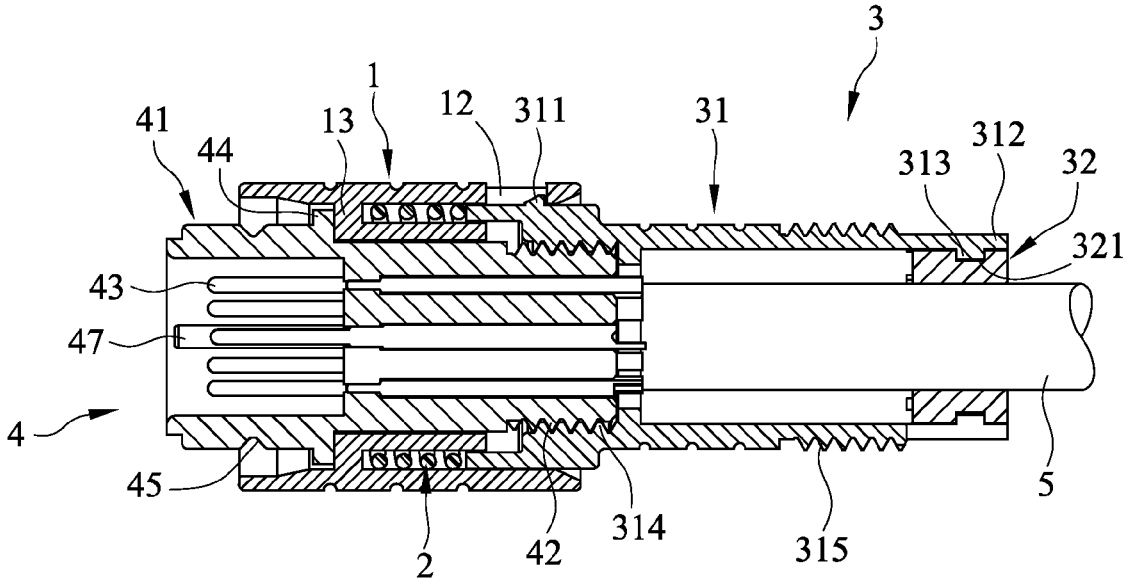
Figure 9:
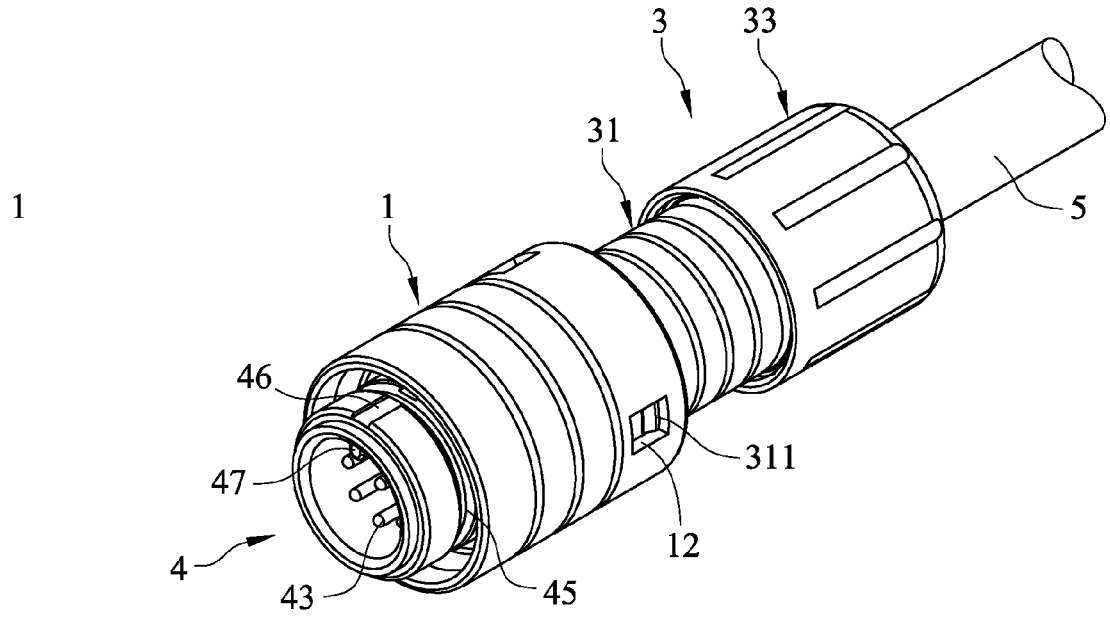

Refer to FIGS. 5, 6, 7, 8 and 9, which are schematic diagrams showing assemblage of the invention. As shown in the figures, in assembling for the invention, the elastic element 2 may be disposed in the containing area 11 of the inner edge of the sliding bush 1, followed by disposing the collar 32 between an end of the sleeve 31 and each elastic piece 312 for the collar 32 to be docked with the sticking points 313 of the inner surface of each elastic piece 312 by the slot 321 mutually, and docked with the respective buckle holes 12 of the sliding bush 1 by the buckles 311. The buckle holes 12 of the sliding bush 1 are larger than the buckles 311 of the sleeve 31, so that the sliding bush 1 may slide on the sleeve 31. After that, a wire 5 is used to penetrate through the locking bush 33, the sliding bush 1 and the sleeve 31, the wire 5 is connected with each insertion terminal 43 of the connector plug 4, the second external thread portion 42 of the connector plug 4 is joined with the first internal thread portion 314 of the sleeve 31, and at last, the locking bush 33 is joined with the first external thread portion 315 of the sleeve 31 by the second internal thread portion 331 thereof. As such, the assemblage is accomplished.

Figure 10:
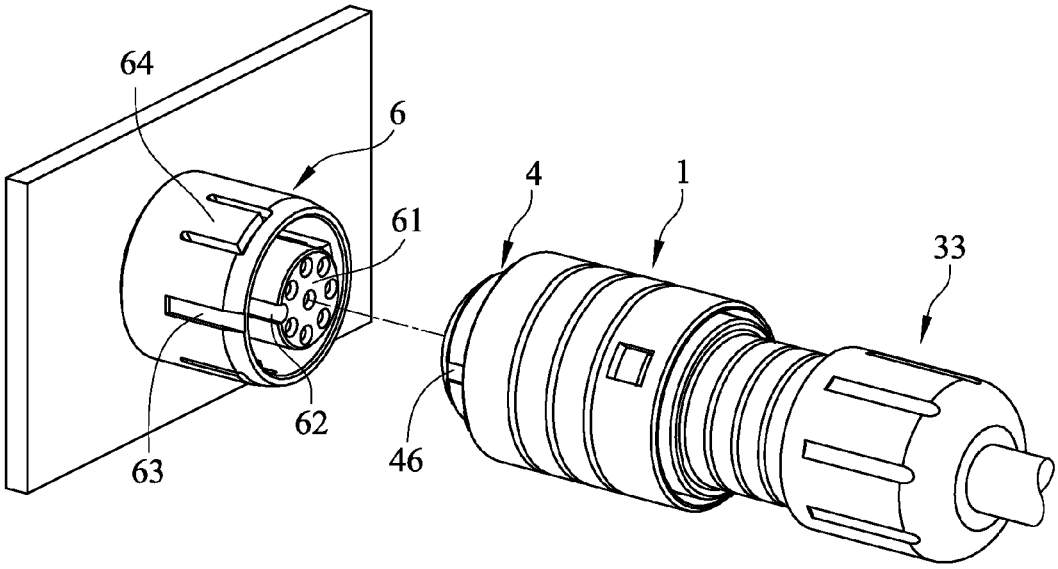
FIG. 10 is a schematic diagram showing operation of the invention.
Figures 1, 11:
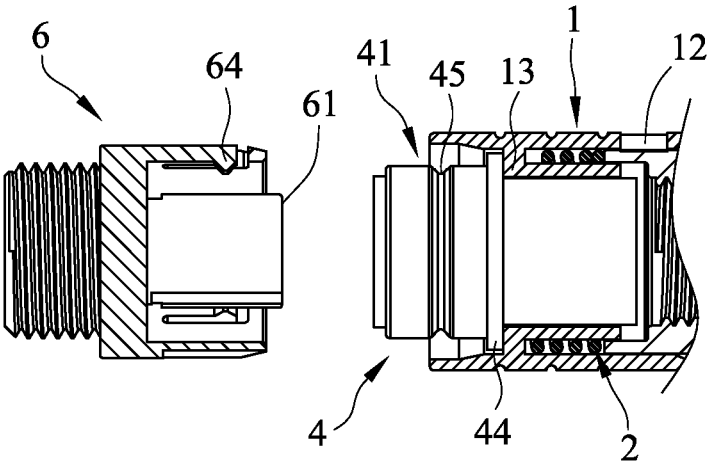
Figures 2, 11:
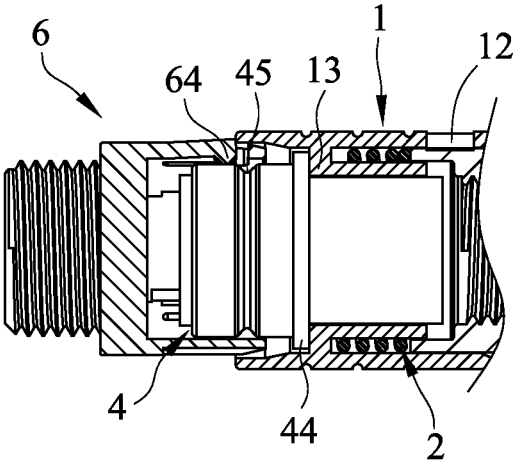
Figures 3, 11:
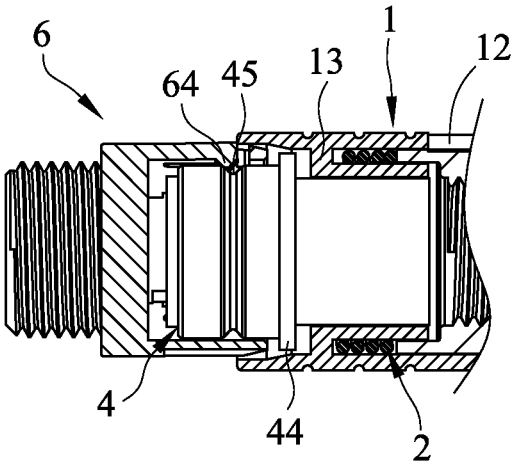
Figures 4, 11:
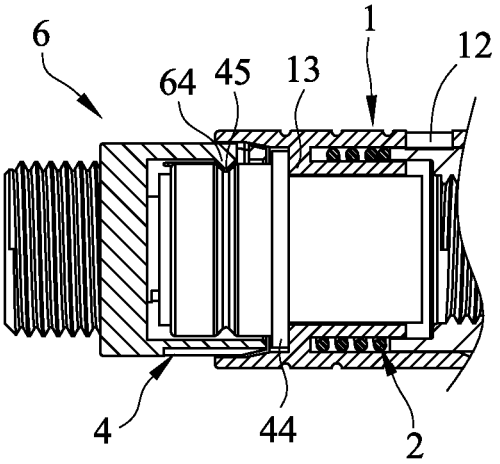

Refer to FIG. 10 and FIGS. 11-1 to 11-4, which are a schematic diagram showing operation of the invention and schematic diagrams showing actions of assemblage and disassemblage of the invention. As shown in the figures, the invention may be inserted to a corresponding connection socket 6 in use, while a user may correspond to the socket body 61 of the connection socket 6 by the connector plug 4 in docking, and correspond to the marking portion 63 of the connection socket 6 by the marking portion 46 of the connector plug 4, thereby the guiding portion 47 of the connector plug 4 corresponds to groove 62 of the connection socket 6 in order to identify insertion direction, such that incorrect insertion is avoided. As the top portion 41 of the connector plug 4 is docked to the socket body 61, the periphery of the top portion 41 will withstand each buckle 64 of the connection socket 6 for each buckle 64 to be opened. In the mean time, an end of each buckle 64 will abut against the end edge of the sliding bush 1, such that the sliding bush 1 is pushed toward the holding unit 3 (rearwards) and compresses the elastic element 2, and be removed from the end edge of the sliding bush 1 after each buckle 64 enters the ditch 45 of the top portion 41, while the sliding bush 1 is pushed back toward the top portion 41 (forwards) automatically due to restitution force, such that the sliding bush 1 is locked on the outer edge of each buckle 64 of the connection socket 6 to limit each buckle 64 for each insertion terminal 43 to be inserted into the socket body 61, and thereby, to accomplish insertion operation.

In disassembling, the sliding bush 1 is pulled toward the holding unit 3 (rearwards), such that the sliding bush 1 is no longer locked to the outer edge of each buckle 64. After that, a force may be applied to remove the connector plug 4 from the connector plug 6 directly by the user.

In summary, with the description above, the invention can achieve actually the expected objectives of the invention, such that in assembling, direct docking with the connection socket by the connector plug is available for the connection socket to push away the sliding bush. After the connection socket and the connector plug are snap-fitting, the sliding bush is pushed back by the elastic element automatically, such that the sliding bush is locked to outer edge of the connection socket to complete operation of assemblage. In disassembling, the sliding bush is pulled backwards simply such that the sliding bush is not limited to the outer edge of the connection socket any more. After that, a force may be applied to remove the connector plug from the connection socket directly. As a result, the effects of rapid assembling, solid joining, rapid disassembling, simple structure and ease of use are achieved.

While the description above are only preferred embodiments of the invention. Any equivalent modification made within the scope of claims of the invention shall be within the substantial scope of the invention.

What is claimed is:

1. A circular rapid-joint connector, including:

a sliding bush;

an elastic element provided on the inner edge of the sliding bush;

a holding unit joined with the sliding bush movably; and a connector plug penetrating into the sliding bush and joined with the holding unit, wherein a containing area capable of accommodating elastic unit is provided on the inner edge of the sliding bush, an end of the sliding bush has multiple buckle holes engaged with the holding unit, and the inner edge of another end of the sliding bush has a stop portion abutting against the connector plug.

2. The circular rapid-joint connector as described in claim 1, wherein the holding unit comprises a sleeve, a collar provided in the sleeve, and a locking bush joined with the sleeve, and wherein an outer edge of the sleeve has multiple buckles docking with the multiple buckle holes respectively, and an end of the sleeve has multiple adjacent elastic pieces, an inner surface of each of the elastic pieces being provided with a respective sticking point, while the periphery of the collar is provided with a slot docking with each of the sticking points, and an inner edge of the sleeve is provided with a first internal thread portion joined with the connector plug, moreover, a first external thread portion is provided on the outer edge of the sleeve where each of the elastic pieces is adjacent thereto, while the inner edge of the locking bush is provided with a second internal thread portion joined with the first external thread portion.

3. A circular rapid-joint connector, including:

a sliding bush;

an elastic element provided on the inner edge of the sliding bush;

a holding unit joined with the sliding bush movably; and a connector plug penetrating into the sliding bush and joined with the holding unit, wherein the holding unit comprises a sleeve, a collar provided in the sleeve, and a locking bush joined with the sleeve, and an end of the sliding bush has multiple buckle holes engaged with the holding unit, and wherein an outer edge of the sleeve has multiple buckles docking with the multiple buckle holes respectively, and an end of the sleeve has multiple adjacent elastic pieces, an inner surface of each of the elastic pieces being provided with a respective sticking point, while the periphery of the collar is provided with a slot docking with each of the sticking points, and an inner edge of the sleeve is provided with a first internal thread portion joined with the connector plug, moreover, a first external thread portion is provided on the outer edge of the sleeve where each of the elastic pieces is adjacent thereto, while the inner edge of the locking bush is provided with a second internal thread portion joined with the first external thread portion.

4. The circular rapid joint connector as described in claim 3, wherein the buckle holes of the sliding bush are larger than the buckles of the sleeve.

* * * * *